US006000648A

United States Patent [19]

Ambrose

[11] Patent Number: 6,000,648

[45] Date of Patent: Dec. 14, 1999

[54] CONE CRUSHER HAVING INTEGRAL SOCKET AND MAIN FRAME

[75] Inventor: David W. Ambrose, Mequon, Wis.

[73] Assignee: ANI Mineral Processing, Inc., Brookfield, Wis.

[21] Appl. No.: 09/172,970

[22] Filed: Oct. 14, 1998

[51] Int. Cl.[6] ..... B02C 15/10

[52] U.S. Cl. ..... 241/215

[58] Field of Search ..... 241/207–216

[56] References Cited

U.S. PATENT DOCUMENTS

| | | | |
|---|---|---|---|
| 4,750,681 | 6/1988 | Sawant et al. | 241/208 |
| 4,895,311 | 1/1990 | Arakawa | 241/207 |
| 5,031,843 | 7/1991 | Motz | 241/21 |
| 5,738,288 | 4/1998 | Karra | 241/207 |
| 5,810,268 | 9/1998 | Ganser, IV et al. | 241/207 |
| 5,820,045 | 10/1998 | Karra | 241/207 |

*Primary Examiner*—Mark Rosenbaum
*Attorney, Agent, or Firm*—Michael Best & Friedrich LLP

[57] ABSTRACT

A cone crusher having a crusher head assembly including a crusher head having a cone-shaped surface and an underside opposite the cone-shaped surface, the underside having an annular socket engagement surface, a one-piece frame including a peripheral portion and a central portion, the central portion having a wall forming a socket having an upper edge providing a continuous annular head support surface engaged with the socket engagement surface, the upper edge of the wall defining an opening, the wall defining a socket bore extending from the opening into the central portion, the central portion having a hub located within the socket and extending into the socket bore; and an eccentric assembly supported on the hub, the eccentric assembly including an eccentric member engaged with the crusher head assembly and including a ring gear fixed to said eccentric member, the ring gear being housed by the socket bore in a position surrounding the hub, the gear ring being removable through the opening.

16 Claims, 3 Drawing Sheets

CONE CRUSHER HAVING INTEGRAL SOCKET AND MAIN FRAME

FIELD OF THE INVENTION

The present invention generally relates to the field of crushers used to crush aggregate into smaller pieces. More specifically, the present invention relates to eccentric cone crushers.

BACKGROUND OF THE INVENTION

1. Technical Field

Crushers are used to crush large aggregate particles (e.g., rocks) into smaller particles. One particular type of crusher is known as a cone crusher. A typical cone crusher includes a frame supporting a crusher head and a mantle secured to the head. The frame also supports a bowl and bowl liner so that an annular space is formed between the bowl liner and the mantle. In operation, large particles are fed into the annular space between the bowl liner and the mantle. The head, and the mantle mounted on the head, gyrate about an axis, causing the annular space to vary. As the distance between the mantle and the bowl liner varies, the large particles are impacted and compressed between the mantle and the bowl liner. The particles are crushed and reduced to the desired product size, and then dropped down from between the mantle and the bowl liner.

2. Related Prior Art

U.S. Pat. No. 4,750,681, which issued to Sawant et al. on Jun. 14, 1988, discloses such a cone crusher. The crusher includes a head 146 which is supported on a cylindrical support shaft 30 above an eccentric assembly 48. The upper end of the support shaft 30 supports a spherical seat 138 and base 140 which, in turn slidingly support a spherical bearing 142 fixed to the crusher head 146. The crusher disclosed by the Sawant patent (U.S. Pat. No. 4,750,681) also includes structural components extending between the frame of the crusher and the undersurface of the head. In particular, a counterweight assembly 55 has a lower seal 56 that cooperates to provide an interface between the frame, particularly flange 54, and countershaft box 52 and the counterweight assembly 55. Similarly, an upper seal 158 provides an interface between the undersurface of the head assembly 144 and the counterweight assembly 55.

U.S. Pat. No. 5,031,843, which issued to Motz on Jul. 16, 1991, also discloses a cone crusher. The Motz patent includes a head assembly 32 including a head 34. The Motz patent crusher also includes a frame 12 that supports the head 34 by contacting the underside of the head 34. The frame 12 includes a central hub and an outer hub. The outer hub supports a socket and seal assembly which is mounted on the frame of the crusher and which extends upwardly to support the underside of the head.

SUMMARY OF THE INVENTION

One of the problems with existing cone crushers is that gaining access to the interior of the crusher for maintenance, repair, set-up changes, etc., can be difficult. Prior art crushers of the type described above exemplify the nature of this problem. In the case of the crusher disclosed by the Sawant reference, in order to remove the head assembly and eccentric assembly from the frame, the bowl must be removed from its supporting structure. Then cap bolt 155, cap 154 and lock nut 152 can be removed from the head assembly 144 to permit attachment of a lifting structure to the head assembly. Then the head assembly 144 can be lifted upwardly off the shaft 30, bearing seat 138 and eccentric 48. Then the bearing seat 138 and base portion 140 must be removed from the top of shaft 30. Then the eccentric assembly including the ring gear and counterweight assembly 55 can be lifted off the shaft 30.

In the case of the Motz reference, in order to remove the head assembly and eccentric assembly, the upper feed deflector and bowl must be removed. Then the cap and cap bolts and lock nut must be removed so that a lifting fixture can be attached to the head assembly. The head assembly can then be lifted upwardly off the socket. However, before the eccentric assembly, including the gear ring and counterweight can be removed, the socket and seal assembly must be dismantled to provide sufficient clearance for removal of the gear ring and counterweight. Only then can the eccentric assembly be pulled up and off the shaft 18.

To overcome the problems associated with existing cone crushers, the present invention provides an eccentric cone crusher having components that facilitate assembly and disassembly of the cone crusher. More particularly, the invention provides a cone crusher having a frame assembly, an eccentric assembly and a crusher head assembly which are configured to provide a cone crusher having a modular, relatively simple construction. The crusher can be maintained, repaired, and adjusted, with minimal disassembly and assembly.

In one embodiment, the invention provides a cone crusher including frame assembly having a single-piece, integrally-formed main frame member. The main frame member defines a central hub and main shaft bore extending into the hub. The main frame also defines a head support or socket that surrounds the hub. The socket provides an annular head supporting surface that extends around the underside of the head. The socket is a cup-like structure integrally formed with the main frame and defines a bore which is sized to receive an eccentric assembly without disassembly of either the socket or the eccentric assembly. The cone crusher also includes an eccentric assembly that is received by, and is mounted on, the main frame, and a head assembly that is supported by the main frame socket liner and that is engaged to the eccentric.

In another embodiment, the invention provides a cone crusher having a crusher head assembly including a crusher head. The crusher head has cone-shaped surface and an underside opposite the cone-shaped surface, the underside having an annular socket engagement surface. The crusher also includes a one-piece frame including a peripheral portion and a central portion, the central portion having a wall forming a socket having an upper edge. The upper edge provides a continuous annular head support surface engaged with the socket engagement surface, the upper edge of the wall defining an opening, the wall defining a socket bore extending from the opening into the central portion, the central portion having a hub located within the socket and extending into the socket bore. The crusher also includes an eccentric assembly supported on the hub, the eccentric assembly having an eccentric member engaged with the crusher head assembly and including a ring gear fixed to said eccentric member. The ring gear is housed by the socket bore in a position surrounding the hub, and the gear ring is removable through the opening.

In another embodiment, the invention provides a cone crusher having a crusher head assembly including a crusher head having a crushing surface and a bearing surface opposite the crushing surface. The crusher also has a frame including a socket having an annular, continuous head support surface engaged with the bearing surface on the crusher head. The socket defines a socket bore extending from the head support surface. The frame also includes a hub located within the socket and extending into the socket bore. The crusher also includes an eccentric assembly supported on the hub. The eccentric assembly includes an eccentric member engaged with the crusher head assembly and includes a ring gear fixed to said eccentric member. The ring gear is housed within the socket bore in a position surrounding the hub, and the eccentric is removable from the hub without the need to take apart either the eccentric assembly or the socket.

In another embodiment, the invention provides a cone crusher having a crusher head assembly including a crusher head having a crushing surface and a bearing surface opposite the crushing surface. The crusher also includes a frame including a hub having a first end, a second end spaced from the first end, and a cylindrical outer surface extending between the first end and the second end. The hub also includes a bore extending into the hub from the first end toward the second end, and a mounting surface at the first end of the hub extending between the outer surface of the hub and the bore in the hub. The frame also includes an annular surface surrounding the second end of the hub, a socket surrounding the hub and extending from the annular surface surrounding the second end of the hub to an upper edge. The upper edge of the socket includes an head support surface engaged with the bearing surface on the crusher head. The socket defines a socket bore, and the socket, annular surface and outer surface of the hub define a ring gear pocket communicating with the socket bore. The crusher also includes an eccentric assembly supported on the mounting surface attached to and supported by the main frame and extending into the socket bore. The eccentric assembly includes an eccentric member engaged with the crusher head assembly and includes a ring gear housed within the ring gear pocket, the eccentric being removable from the hub without taking apart either the eccentric assembly or the socket.

One advantage of the invention is the provision of a cone crusher having an eccentric assembly that can be accessed, and removed if desired, without the need for dismantling any structure on the frame or the eccentric assembly which may interfere with such access or removal. This advantage is achieved by providing a socket configuration which supports the head but which also is located sufficiently away from the central axis of the crusher to afford clearance between the eccentric assembly and the head supporting structure. The socket thus permits the eccentric to be nested within the inner diameter of the socket without the need for additional seals or supporting structure to be assembled on the socket.

Other features and advantages of the invention will become apparent to those skilled in the art upon review of the following detailed description, claims and drawings.

Figure 1:
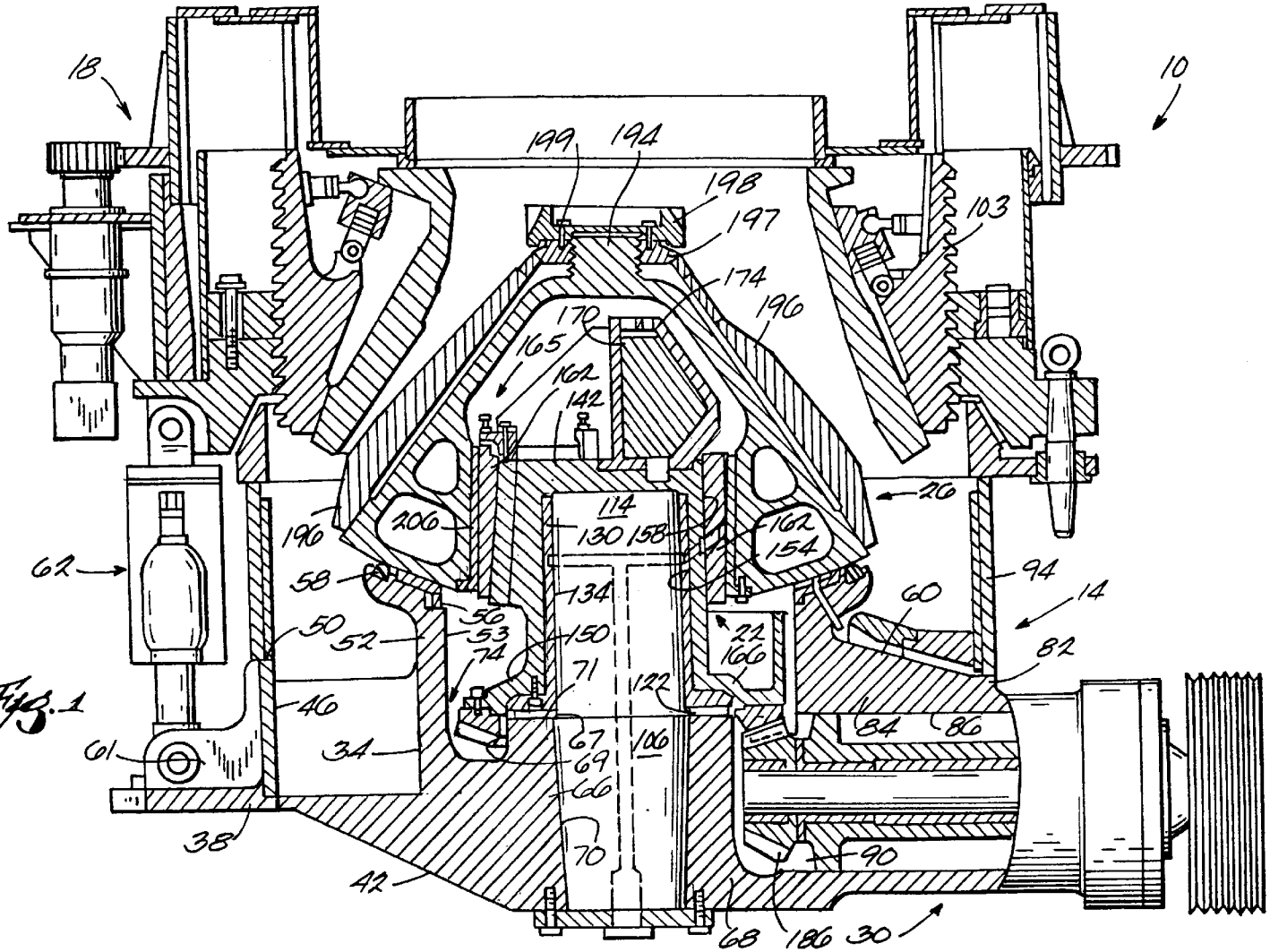
FIG. 1 is a cross-sectional view of a cone crusher embodying the present invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

The drawings illustrate a cone crusher 10 which embodies the invention. The crusher 10 is operable to crush large aggregate and ore particles, e.g., rocks, into smaller particles. In general, the crusher 10 includes a frame assembly 14, a bowl assembly 18 supported by the frame assembly 14, an eccentric assembly 22 which is mounted on the frame assembly 14, a crusher head assembly 26 which engages the eccentric assembly 22 and which is supported by the frame assembly 14 for rotation relative to the frame assembly 14 and to the bowl assembly 18, and a drive system 30 for rotating the eccentric and head assemblies.

More particularly, the frame assembly 14 includes one-piece, integrally formed main frame 34 which has a generally planar, plate-like peripheral portion 38 and a relatively thick central portion 42. The peripheral portion 38 of the main frame 34 is delineated with respect to the central portion 42 by a vertically extending step or annular outer wall 46. The upper edge of the outer wall 46 is continuous and provides an upwardly facing barrel mounting surface 50.

The central portion 42 of the main frame 34 includes a second vertical wall or socket 54 that is located radially inwardly of the outer wall 46. The socket 54 defines a cup-like structure and extends up from the central portion 42 of the main frame 34 to an upper edge 56. The upper portion of the socket 54 splays radially outwardly from the upper edge 56 and defines an upwardly facing and inwardly sloping socket liner mounting surface 58. The socket 54 is integrally formed with the main frame 34, and supports thereon the head assembly 26 in a manner discussed below.

The socket 54 defines a socket bore 62 extending from upper edge 56 of the socket 54 downwardly into the central portion 42 of the main frame 34. The socket bore 62 opens upwardly and has a uniform diameter and defines an opening 64 at the upper edge 56 of the socket 54. Importantly, the minimum opening 64 at the top of the socket bore 62 is sized to receive therein several components of the eccentric assembly 22 without necessitating any assembly or disassembly of either the eccentric assembly 22 or the socket 54 to afford movement of the eccentric assembly 22 into and out of housed relation with the socket bore 62. While in the illustrated embodiment the socket bore 62 is illustrated as being defined by a vertically extending cylindrical surface, those of ordinary skill in the art will readily understand that the socket bore 62 could also be configured so as to taper outwardly from bottom to top, thus still providing a head support surface and sufficient clearance to permit passage of the eccentric assembly 22 past the head supporting structure.

The main frame 34 also defines a centrally located hub 66 defined by a thick cylindrical wall. The hub 66 has a first, upper end 67 and a second, lower end 68. The hub 66 also has a cylindrical outer surface 69 extending between the upper and lower ends 67, 68. A main shaft bore 70 extends inwardly of the hub 66 from the upper end 67 toward the lower end 68 so that the upper end 67 has an annular, upwardly facing thrust bearing mounting surface 71 surrounding the main shaft bore 70 at the upper end of the hub 66. For reasons discussed below, the main shaft bore is centered on a central axis of rotation 78, but tapers or converges as it extends downwardly, i.e., the inner diameter of the bore is greater at its upper end than at its lower end. The hub 66 extends upwardly from the central portion 42 of the main frame 34. into the socket bore 62 so that the annular surface 72 surrounding the lower end of the hub 66, the outer surface of the hub 66, and the lower portion of the socket bore 62 define therebetween a counterbore portion or ring gear pocket 74 that surrounds the hub 66 and that communicates with the socket bore 62. This annular ring gear pocket 74 has an inner diameter defined by the outer surface of the hub 66 and an outer diameter defined by the socket bore 62.

The main frame 34 also defines a countershaft box assembly housing 82 which extends from one side of the outer portion of the main frame 34 into the central portion 42 of the main frame 34, and into proximity with the ring gear pocket 74. To accommodate the drive system 30 which is described in more detail below, in one region of the ring gear pocket 74, the gear ring pocket 74 communicates with the countershaft bore 86 defined by the countershaft box assembly housing 82 and defines therewith a pinion housing 90. Importantly, the socket 54 and socket liner mounting surface 58 extend in a continuous, uninterrupted manner about the entire central portion 42 of the main frame 34, including the region of the main frame 34 providing the countershaft box assembly housing 82.

The main frame 34 is further described in the following co-pending U.S. Patent Application, which is assigned to the assignee hereof and which is incorporated herein by reference: Ser. No. 09/172,986, filed concurrently herewith and titled "Main Frame for Eccentric Cone Crusher".

The frame assembly 14 also includes a vertically extending, generally cylindrical barrel section 94 that is mounted on the barrel mounting surface 50 of the outer wall 46. The barrel section 94 generally defines the interior, crushing chamber of the crusher 10. The frame assembly 14 also includes an adjustment ring seat 98 which is fixed to the upper region of the barrel section 94, and an adjustment ring 102 which is mounted on the adjustment ring seat and upon which the bowl assembly 18 is mounted.

Figure 2:
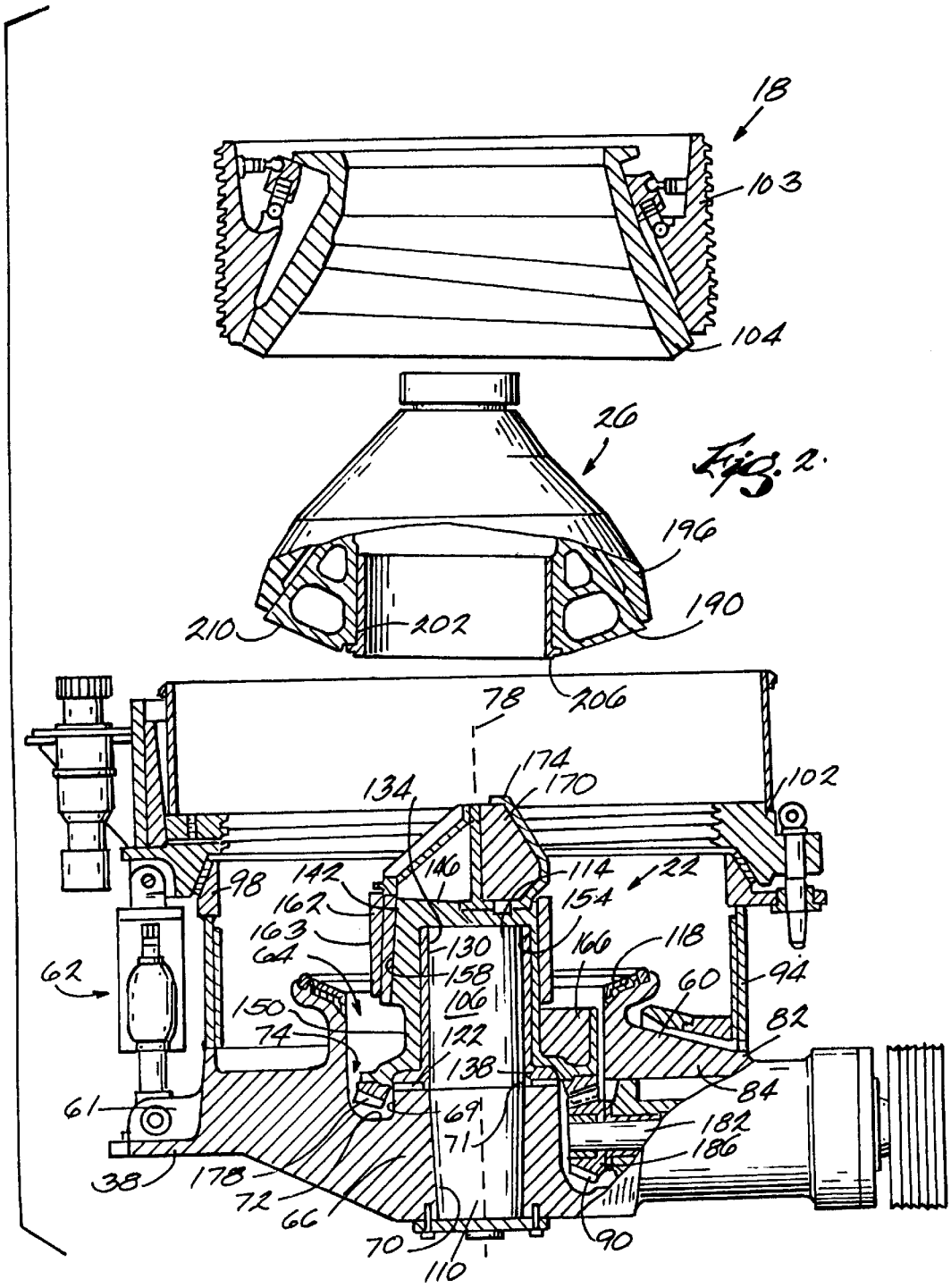
FIG. 2 is an exploded, cross-sectional view of the cone crusher illustrated in FIG. 1.
Figure 3:
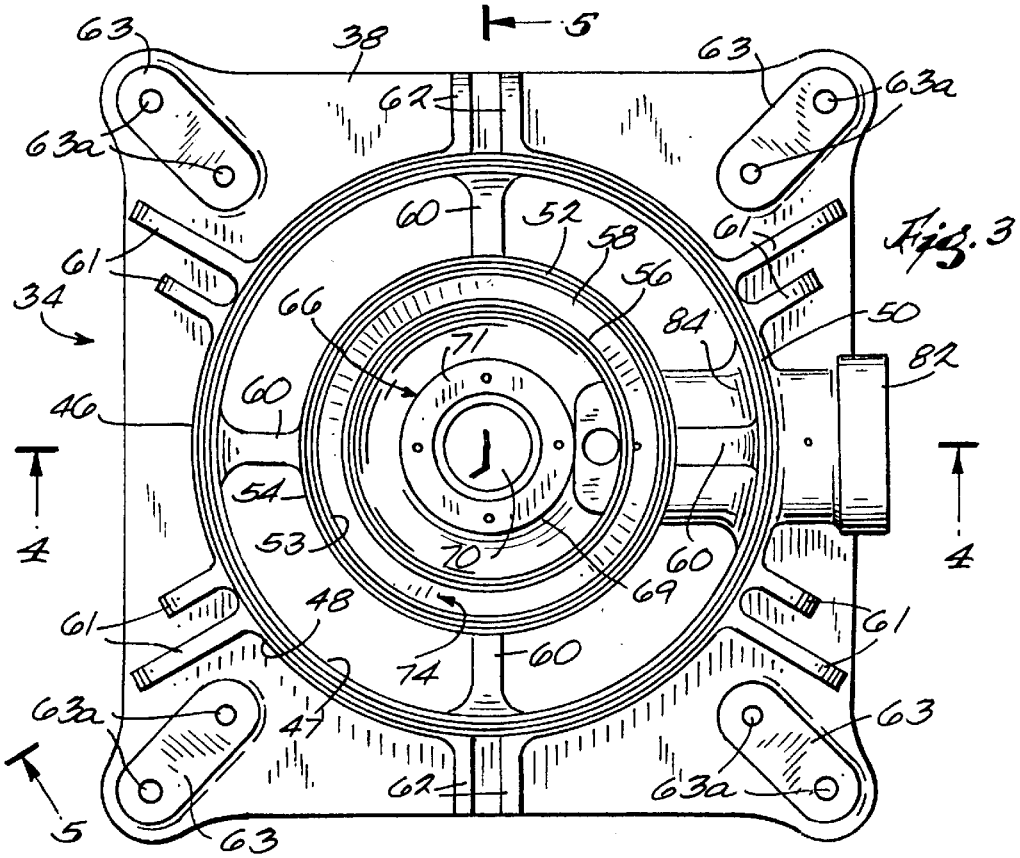
Figure 4:
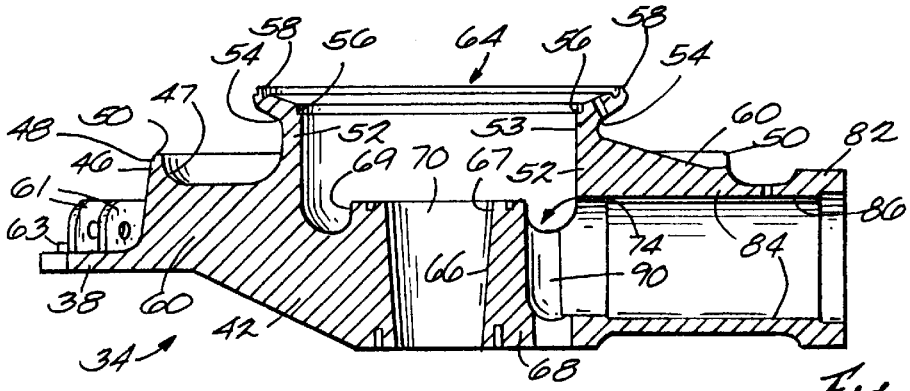
Figure 5:
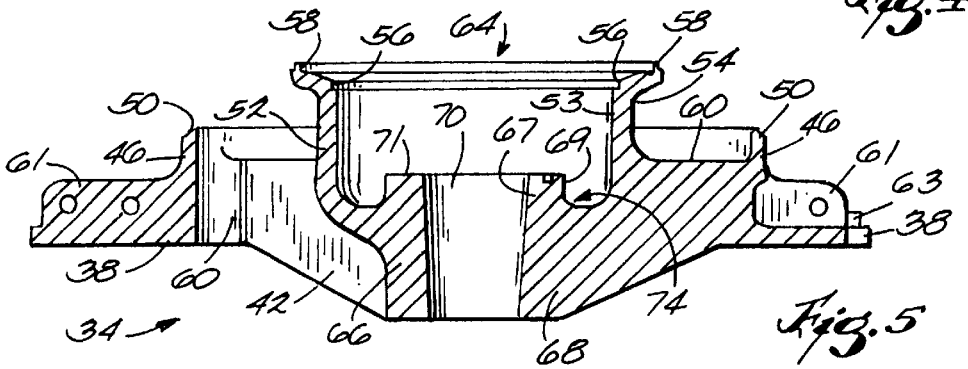

In this regard, the bowl assembly 18 is mounted on the adjustment ring 102, and includes a bowl 103 and a bowl liner 104 which is secured to the bowl. The bowl liner 104 provides a generally frusto-conical crushing surface 105. The bowl 103 is threadedly mounted on the adjustment ring 102 in a manner affording adjustment of the height of the bowl 103 and bowl liner 104 relative to the adjustment ring 102 and the head assembly 26 along the axis 78. As shown in FIG. 2, and for reasons discussed below, the bowl assembly 18 can be entirely removed from the support of the adjustment ring 102.

The frame assembly 14 also includes a main shaft 106 that is received by the main shaft bore 70. The main shaft 106 has a lower, tapered portion 110 that mates with the taper in the main shaft bore 70. The main shaft 106 also has an upper portion 114 that extends from the lower portion 110 to an upper end 116. The upper portion 114 of the main shaft extends upwardly outward of the main shaft bore 70 and outward of the socket bore 62 as well, so that the upper end 116 of the shaft 106 is located vertically above the upper edge 56 of the socket 54. As discussed below, and as best shown in FIG. 1, the head assembly 26 and the eccentric assembly 22 are concentrically arranged on and about the main shaft 106.

The frame assembly 14 also includes a socket liner 118 located on and fixed to the socket liner mounting surface 58. The socket liner 118 is frusto-conical in that it slopes from the radially outer edge of the socket 54 downwardly toward the upper edge 56 of the socket bore 62. As explained below, the upper surface of the socket liner 118 engages and slidingly supports the underside of the crusher head assembly 26 and, with the head assembly 26, defines an interface which is in sliding contact during operation of the crusher 10.

The frame assembly 14 also includes an annular thrust bearing 122 mounted on the thrust bearing mounting surface 71 in surrounding relation to the main shaft 106. The frame assembly 14, and more specifically, the thrust 45 bearing 122 and shaft 106, supports the eccentric assembly 22 on the hub 66. The vertical loads transferred through the head assembly 26 to the eccentric assembly 22 are transferred from the eccentric assembly 22 to the main frame 34 through the thrust bearing 122. The main shaft 106 provides lateral load bearing support for the eccentric assembly 22 and for the head assembly 26 during operation of the crusher 10.

The eccentric assembly 22 envelops the upper portion 114 of the main shaft 106. More particularly, the eccentric assembly 22 includes an annular bushing 130 which has extending therethrough a bore 134. The bore 134 receives the upper portion 114 of the shaft and provides a sliding contact interface with the cylindrical outer surface of the main shaft 106. The eccentric bushing 130 has an upper end coextensive with the upper portion of the main shaft 106 and a lower end. A flange 138 extends radially from the lower end of the eccentric bushing 130 and overlies the thrust bearing 122 on the hub 66 of the main frame 34.

The eccentric assembly 22 also includes an inner eccentric member 142 which is mounted on, and is rotatable relative to, the upper portion 114 of the shaft 106. The inner eccentric 142 is generally cylindrical and has upper and lower ends 146, 150, and a central bore 154 extending between the ends 146, 150. The bore 154 is eccentrically positioned within the inner eccentric 142 with respect to the outer surface 158 of the inner eccentric 142. The inner eccentric bore 154 houses and is fixed to the eccentric bushing 130 so as to be rotatable in common with the eccentric bushing 130 about the main shaft 106.

More particularly, the outer surface 158 of the inner eccentric 142 has a circular cross-section but, because the bore 154 and that is eccentric relative to the axis 78 when the inner eccentric 142 is mounted on the shaft 106. In other words, the inner cccentric 142 is cylindrical, and the cylindrical wall thickness of the inner eccentric 142 varies from a minimum thickness to a maximum thickness opposite the minimum thickness. Also, the outer surface 158 of the inner eccentric 142 tapers or diverges from top to bottom, i.e., the diameter of the inner eccentric 142 is greater at the bottom than at the top. This taper provides a wedging surface for engaging another component of the eccentric assembly 22, namely, the outer eccentric 162.

The outer eccentric member 162 is supported by the inner eccentric 142 for selective rotational movement relative to the inner eccentric 142 but is fixed to the inner eccentric 142 in a manner discussed below during operation of the crusher 10. The outer eccentric 162 has an outer surface 163 that has a circular cross section and that is eccentric with respect to the inner eccentric 142 member centerline. Similar to the inner eccentric 142, the outer eccentric 162 is preferably annular, and the wall thickness of the outer eccentric 162 varies from a minimum thickness to a maximum thickness opposite the minimum thickness. Also, the outer eccentric 162 defines a tapered bore 164 that mates with the outer surface 158 of the inner eccentric 142. The inner and outer eccentrics 142, 162 are moveable relative to one another to vary the set-up of the cone crusher 10.

The eccentric assembly 22 also includes a locking assembly 165 to selectively prevent and afford rotation of the outer eccentric 162 relative to the inner eccentric 142. Ordinarily, the inner and outer eccentric members 142, 162 are fixed and rotate in common. However, the throw of the crusher 10 can be adjusted by rotating the inner eccentric 142 relative to the outer eccentric 162, and when such relative rotation is desired, the locking mechanism 165 is released to afford such adjustment.

The arrangement of inner and outer eccentrics 142, 162, the locking mechanism 165, and the variation of the crusher's operational settings are further described in the following co-pending U.S. Patent Application, which is assigned to the assignee hereof and which is incorporated herein by reference: Ser. No. 09/173,037 filed concurrently herewith and titled "Variable Throw Eccentric Cone Crusher and Method of Operating the Same".

The eccentric assembly 22 also includes a lower counterweight 166 and an upper counterweight 170, both of which are fixed to the inner eccentric 142. The upper and lower countenveights 166, 170 are positioned and sized to offset the asymmetric configurations of the inner and outer eccentrics 142, 162 and head assembly 26, and to balance the forces acting on the main shaft 106 during operation of the cone crusher 10. More particularly, the upper counterweight 170 is enclosed by a housing 174 which is, in turn, mounted on the top of the inner eccentric 142. The housing 174 is fitted within a recess formed in the top surface of the inner eccentric 142. The upper counterweight 170 is fixed to the inner eccentric 142 in a position immediately adjacent the axis of rotation 78 and to the side of the axis 78 opposite the thicker portion of the inner eccentric 142. Importantly, the upper counterweight 170 has a height and radial extent that permits the crusher head assembly 26 to be positioned over and around the upper counterweight. In this regard, the upper counterweight is located vertically above the upper eccentric, and has a radial extent that is generally co-extensive or less than that of the outer eccentric 162. Thus, the head assembly 26 can house and directly contact the outer, peripheral surface of the outer eccentric 162, but can also be moved vertically off the eccentric assembly 22 without the necessity of removing the upper counter weight 170 from the eccentric assembly 22.

Similarly, the lower counterweight 166 is also fixed to the inner eccentric 142, and is generally opposite the thicker portion of the inner eccentric 142, i.e., on the same side of the axis 78 of rotation as the upper counterweight 170. In the illustrated embodiment of the crushler 10, the lower counter is integrally formed with the lower end of the inner eccentric 142. However, it will be readily understood that the lower counterweight could also be in the form of an annular assembly that is bolted to the eccentric or is otherwise removable fastened to the inner eccentric 142. The lower counterweight 166 is positioned vertically below the outer eccentric 162 and is fixed to the inner eccentric 142 so as to not interfere with the assembly and disassembly of the head assembly 26 and the eccentric assembly 22. More particularly in this regard, when the eccentric assembly 22 is mounted on the main frame 34, the lower counterweight 166 is located within the socket bore 62 and is located below the head supporting surface provided by the socket 54 and socket liner 118.

The upper counterweight 170 and lower counterweight 166 are further described in the following co-pending U.S. Patent Application, which is assigned to the assignee hereof and which is incorporated herein by reference: Ser. No. 09/172,987 filed concurrently herewith and titled "Eccentric Cone Crusher having Multiple Counterweights".

The eccentric assembly 22 also includes an annular, continuous ring gear 178. The ring gear 178 is positioned in surrounding relation to the hub 66 and occupies the ring gear pocket 74 of the socket bore 62. The ring gear 178 thus has a diameter that is less than the diameter of the socket bore 62, and that is also less than the diameter of the opening 64 at the top of the socket bore 62. The ring gear 178 is fixed to the lower end of the inner eccentric 142 and to the lower counterweight 166. The ring gear 178 has a lowver, toothed face which is in driven engagement with the drive system 30. In this regard, the drive system 30 includes a counter shaft 182 housed in the countershaft bore 86 and a pinion 186 mounted on one end of the countershaft 182. A prime mover (not shown) rotatably drives the countershaft 182 and the pinion 186. The ring gear 178 meshes with the pinion 186 and is therefore in driven relation with the countershaft 182. Rotation of the pinion 186 drives the ring gear 178 and the remainder of the eccentric assembly 22 about the axis 78, which rotation also causes the head assembly 26 to rotate about the axis 78 and about the bowl assembly 18.

The radial extent of the eccentric assembly 22, relative to the crusher axis 78, lies within the radial extent of the socket bore 62, and particularly is less than the radius of the minimum opening 64 provided by the socket bore 62. This permits the eccentric assembly 22, including the lower counterweight 166 and the ring gear 178 fixed to the inner eccentric 142 to be removed by passing the ring gear 178 through the opening 64 without the need for taking apart the ring gear 178 or the counterweight assembly. Also, the crusher head supporting surfaces at the socket liners 118 are located radially away from the axis of rotation 78 to provide sufficient clearance for passage of the eccentric assembly 22 through the socket bore opening 64 without disassembly of the socket 54 or the eccentric.

The head assembly 26 includes a crusher head 190 supported for rotation relative to the main frame 34 and driven by the drive system 30 for eccentric rotation about the central crusher axis 78. More particularly, the crusher head 190 is cone-shaped and has a truncated, generally frustoconical outer surface. The crusher head 190 also has a threaded stem 194 extending from the apex of the outer surface, and a generally hollow interior. The head assembly 26 also includes a mantle 196 mounted on and fixed to the outer surface of the crusher head 190. The mantle 196 provides a crushing surface which is in opposed facing relation to the crushing surfaces provided by the bowl liner. The head assembly 26 also includes a lick ring 197 which threadedly engages the stem 194 and which engages the mantle 196 and, in part, holds the mantle 196 in position on the crusher head 190. A cap 198 and cap bolts 199 overlie the lock ring 197. The cap 198 can be readily removed so that a lifting fixture (not shown) can be attached to the head assembly 26.

The crusher head 190 also has extending therein a centrally located bore 202 which communicates with the interior of the crusher head 190). The bore 202 houses a crusher head bushing 206 which is fixed to the crusher head 190 and which is telescopically received by the outer eccentric 162. The bushing 206 and outer eccentric 162 are slidable relative to each other and permit rotation of the crusher head 190 relative to the outer eccentric 162.

The underside of the crusher head 190 provides an annular socket engagement surface 210 that is continuous about the radially outward region of the crusher head 190. The socket engagement surface 210 engages the upper, bearing surface of the socket liner 118 when the head assembly 26 is positioned over the eccentric assembly 22 and onto the main frame 34. The socket liner 118 and socket 54 thus support the head assembly 26 in a position wherein the frame assembly 14 and houses the upper portion of the eccentric to assembly 22. The crusher head 190, supported by the socket 54 and socket liner 118, is rotatable about the axis 78 by rotation of the eccentric assembly 22. However, there is no fastened connection between the crusher head assembly 26 and the eccentric assembly 22. Rather, once the protective cap 198 is removed from the crusher head 190 and a lifting fixture is attached to the crusher head 190, the crusher head assembly 26 can be lifted off the shaft and eccentric assembly 22, and out of engagement with the socket 54 without disassembly of any components. This lift-off feature is achieved by providing the outer eccentric 162 and upper counterweight assemblies 170 with envelops that pass through the opening 64 of the crusher head bore 202, and by providing support surfaces 118 for accepting the vertical loading from the crusher head 190 in a position that does not interfere with the positioning of the eccentric assembly 22 relative to the main shaft 106.

Once the crusher head 190 is removed from the frame assembly 14 and the eccentric assembly 22, the eccentric assembly 22 can be lifted off the thrust bearing 122 and out of the socket bore 62 without any disconnection of structural components or disassembly of either the socket 54 or the eccentric assembly 22. The facility of lifting the eccentric assembly 22 off the main frame 34 is achieved in part by providing the radially spaced crusher head support surfaces 118 on a radially spaced socket 54, and by providing a socket bore 62 that does not constrict the opening 64 adjacent to the crusher head support surfaces 118. Also, the crusher 10 includes an eccentric assembly 22 having a lower counterweight 166 and ring gear 178 that each can pass through the opening 64 provided by the socket bore 62, thus eliminating the need for any disassembly of either the socket 54 or the eccentric assembly 22.

Various features of the invention are set forth in the following claims.

I claim:

1. A cone crusher comprising:

a crusher head assembly including a crusher head having cone-shaped surface and an underside opposite the cone-shaped surface, the underside having an annular socket engagement surface, a one-piece frame including a peripheral portion and a central portion, the central portion having a wall forming a socket having an upper edge providing a continuous annular head support surface engaged with the socket engagement surface, the upper edge of the wall defining an opening, the wall defining a socket bore extending from the opening into the central portion, the central portion having a hub located within the socket and extending into the socket bore; and an eccentric assembly supported on the hub, the eccentric assembly including an eccentric member engaged with the crusher head assembly and including a ring gear fixed to said eccentric member, the ring gear being housed by the socket bore in a position surrounding the hub, the gear ring being removable through the opening.

2. The cone crusher set forth in claim 1 wherein the opening is circular and has a diameter, and wherein the ring gear is annular and has an outer diameter less than the diameter of the opening.

3. The cone crusher set forth in claim 2 wherein the eccentric assembly further includes a second counterweight fixed to the eccentric member.

4. The cone crusher set forth in claim 1 wherein the eccentric assembly includes a counterweight which is fixed to the eccentric member, the counterweight being housed in the socket bore and being removable through the opening.

5. The cone crusher set forth in claim 4 wherein the counterweight is integrally formed with the eccentric member.

6. A cone crusher comprising:

a crusher head assembly including a crusher head having a crushing surface and a bearing surface opposite the crushing surface, a frame including a socket having an annular, continuous head support surface engaged with the bearing surface on the crusher head, the socket defining a socket bore extending from the head support surface, the frame including a hub located within the socket and extending into the socket bore; and an eccentric assembly supported on the hub, the eccentric assembly including an eccentric member engaged with the crusher head assembly and including a ring gear fixed to said eccentric member, the ring gear being housed within the socket bore in a position surrounding the hub, the eccentric assembly being removable from the hub without taking apart either the eccentric assembly or the socket.

7. The cone crusher set forth in claim 6 wherein the opening is circular and has a diameter, and wherein the ring gear is annular and has an outer diameter less than the diameter of the opening.

8. The cone crusher set forth in claim 7 wherein the counterweight is integrally formed with the eccentric member.

9. The cone crusher set forth in claim 7 wherein the eccentric assembly further includes a second counterweight fixed to the eccentric member.

10. The cone crusher set forth in claim 6 wherein the eccentric assembly includes a counterweight which is fixed to the eccentric member, the counterweight being housed in the socket bore and being removable through the opening.

11. A cone crusher comprising:

a crusher head assembly including a crusher head having a crushing surface and a bearing, surface opposite the crushing surface, a frame including a hub having a first end, a second end spaced from the first end, a cylindrical outer surface extending between the first end and the second end, a bore extending into the hub from the first end toward the second end, a mounting surface at the first end of the hub extending between the outer surface of the hub and the bore in the hub, an annular surface surrounding the second end of the hub, a socket surrounding the hub and extending from the annular surface surrounding the second end of the hub to an upper edge, the upper edge of the socket including a head support surface engaged with the bearing surface on the crusher head, the socket defining a socket bore, and the socket, annular surface and outer surface of the hub defining a ring gear pocket communicating with the socket bore; and an eccentric assembly supported on the eccentric mounting surface and extending into the socket bore, the eccentric assembly including an eccentric member engaged with the crusher head assembly and including a ring gear housed within the ring gear pocket, the eccentric assembly being removable from the hub without taking apart either the eccentric assembly or the socket.

12. The cone crusher set forth in claim 11 wherein the upper edge defines an opening wherein the opening is circular and has a diameter, and wherein the ring gear is annular and has an outer diameter less than the diameter of the opening.

13. The cone crusher set forth in claim 12 wherein the eccentric assembly further includes a second counterweight fixed to the eccentric member.

14. The cone crusher set forth in claim 11 wherein the eccentric assembly includes a counterweight which is fixed to the eccentric member, the counterweight being housed in the socket bore and being removable through the opening.

15. The cone crusher set forth in claim 14 wherein the counterweight is integrally formed with the eccentric member.

16. The cone crusher set forth in claim 11 wherein the eccentric member is a first eccentric member, wherein frame assembly further includes a main shaft supporting the first eccentric member and wherein the eccentric assembly further includes a second eccentric member engaged with the first eccentric member and with the crusher head.

* * * * *